US005779955A

United States Patent [19]

Siempelkamp

[11] Patent Number: 5,779,955

[45] Date of Patent: Jul. 14, 1998

[54] METHOD OF MAKING SHAPED BODIES ESPECIALLY BOARDS

[75] Inventor: Dieter Siempelkamp, Krefeld, Germany

[73] Assignee: G. Siempelkamp GmbH & Co., Krefeld, Germany

[21] Appl. No.: 805,410

[22] Filed: Feb. 24, 1997

[51] Int. Cl.[6] ..... B27N 3/04

[52] U.S. Cl. ..... 264/109; 264/113; 264/115

[58] Field of Search ..... 264/109, 115, 264/113

[56] References Cited

U.S. PATENT DOCUMENTS

| | | | |
|---|---|---|---|
| 4,609,513 | 9/1986 | Israel | 264/122 |
| 4,772,442 | 9/1988 | Trout et al. | 264/109 |
| 5,302,330 | 4/1994 | Umansky et al. | 264/109 |
| 5,554,330 | 9/1996 | Flannery | 264/113 |

FOREIGN PATENT DOCUMENTS 26 47 488 4/1978 Germany .

*Primary Examiner*—Mary Lynn Theisen
*Attorney, Agent, or Firm*—Herbert Dubno

[57] ABSTRACT

Shaped bodies such as board can be made from a mixture of comminuted vegetable matter and an isocyanate binder by forming the mixture with a moisture content in excess of that required to cure the binder, then coating a support for the mixture with a layer of a liquid parting agent, depositing the mixture on the support, coating the mixture with another film of the parting agent and hot pressing the mixture to form the board.

19 Claims, 1 Drawing Sheet

METHOD OF MAKING SHAPED BODIES ESPECIALLY BOARDS

FIELD OF THE INVENTION

My present invention relates to a method of producing shaped bodies, especially boards, from a comminuted vegetable material and a water curable or water hardenable isocyanate binder.

BACKGROUND OF THE INVENTION

U.S. Pat. No. 5,554,330 describes a process for producing pressed board from a mixture of comminuted vegetable matter, i.e. woody or cellulose materials and the like, using a isocyanate binder to which a quantity of water is added that is significantly smaller than the quantity of water required to cure the binder. The remainder of the water necessary to cure the binder is applied to the upper and lower sides of the shaped composition following the shaped step.

A drawback of this approach is that the subsequent application of water makes the quantity of water which must be applied dependent upon the thickness of the shaped body and thus requires meticulous control. Such control precision is very expensive because of the monitoring required and the capital cost of the equipment used. The process is thus also labor intensive.

In practice it has been found that the problems with control can often result in pooling of water on the product and thus a lack of uniformity of the application of the water and hence a lack of uniformity in the curing and in the characteristics of the product.

When water curable isocyanate binders are used, the isocyanate binder in the presence of heat and water tends to cross link to insoluble polyurea type compounds. Because of their high reactivity, isocyanate binders also react with oxide/ hydrate films of metal surfaces with which the binder may come into contact. As a consequence, in the finish processing of shaped bodies, there is a tendency for the compositions to adhere to the press plates or pressing surfaces which can interfere with the press operations and severely limit productivity.

To avoid such problems it has been proposed in DE-OS 26 47 488 to spray the corresponding press surfaces with a liquid parting agent which is intended to prevent sticking of the pressed composition to the plates.

Such approaches to the prevention of sticking cannot be used effectively with process of U.S. Pat. No. 5,554,330 to great effect since the system of the latter patent requires that the remaining water required for curing the isocyanate compounds be applied to these surfaces.

It might be conceivable to admix the parting agent with the particulate composition, but this will result in distribution of the parting agent throughout the pressed body when only a minute quantity of the parting agent may be required at the interface between the composition and the pressing surfaces. Incorporation of the parting agent in the pressed board composition itself has been found to alter the consistency of that composition and change the pressing characteristics and properties of the board which is ultimately produced.

OBJECTS OF THE INVENTION

It is, therefore, the principal object of the present invention to provide an improved method of making pressed products from comminuted vegetable material and water-curable isocyanate binder whereby these drawbacks are avoided.

Another object of the invention is to provide a improved process for producing pressed board of the type described whereby the tendency of the composition to adhere to hot pressing surfaces of metal is reduced or avoided without detriment to product quality.

SUMMARY OF THE INVENTION

These objects and others which will become apparent hereinafter are attained, in accordance with the invention in a process for producing shaped bodies, especially boards, from comminuted vegetable material and a water curable isocyanate binder which has the following features.

(a) a mixture is formed from the comminuted vegetable matter and the isocyanate binder and, water which has a water content above that required for the curing of the isocyanate binder;

(b) a liquid parting agent is applied to a prepared closed support or underlayment;

(c) the mixture of the vegetable matter, binder and water in excess is then applied to the support or underlayment which has been provided with the coating of the parting agent;

(d) another coating of the parting agent is applied to the upper surface of the mat of comminuted material, binder and water; and (e) the mat on the underlayment or support is then pressed in a press at elevated temperature and pressure.

In particular, the method of making shaped bodies of the invention can comprise the steps of:

(a) mixing a comminuted vegetable material with a water-curable isocyanate binder and an amount of water in excess of that required to cure the binder to form a settable mixture;

(b) coating a support for the mixture with a layer of a liquid parting agent;

(c) depositing the settable mixture on the layer of the liquid parting agent on the support;

(d) applying to an upper side of the settable mixture on the support another layer of the liquid parting agent;

(e) thereafter pressing the settable mixture on the support at an elevated temperature and pressure to shape a body from the settable mixture while causing curing of the binder to form a shaped body.

The invention thus deviates significantly from the method of U.S. Pat. No. 5,554,330 since there is no need to supply water after shaping for complete curing, the curing water being present from the beginning.

There is no problem with the pot life of the composition which is to be shaped since the reaction between the isocyanate binder and water at room temperature proceeds relatively slowly and thus time is available for forming the composition, shaping it and initiating the pressing process. It is of considerable advantage that a precise control of the supply of additional water can be obviated since the preparation of the composition can be constant regardless of thickness of the board which is produced. The amount of the liquid parting agent which is used can be minimized, the danger of water pooling on the surface of the board is excluded and fabrication of the board can a proceed without difficulty.

The invention can make use of straw or like vegetable matter, especially straw from a variety of grains including comminuted corn stalks, sawdust or like cellulosic materials. The straw should preferably be comminuted to preferable length of at most 5 mm before being admixed with the isocyanate binder.

The preferred isocyanate binder is diphenylmethane diisocyanate (MDI) and the ratio of comminuted vegetable matter to isocyanate binder is preferably 10:1 to 50:1. The closed underlayment or support can be a sheet metal plate, a plastic sheet or the like, or can include a metal sieve when, for example, the pattern of that sieve is to be impressed in the board which is produced.

The press which is used is preferably a cycling press, i.e. a press having a fixed press cycle involving opening and closing of platens on the pressed product.

The mat itself can be provided as a single layer or from a plurality of layers. The parting agent can be a commercial product used to prevent adhesion of compositions to the press platens for the production of pressed board and is preferably and aqueous soap solution. The parting agent is preferably applied to the support and to the mat each in an amount of 10 to 100 g/m$^2$, preferably by spraying.

To maintain production continuity, residues of the parting agent can be removed from the surfaces of the support and upper press platen before the commencement of a respective cycle.

The mat can be continuously produced by spreading the mixture upon the support and, since the rate at which the mat is formed can vary, I can control the quantity of the parting agent which is applied as a function of the speed of formation of the mat to ensure a constant parting agent quantity as applied to the mat and to the support. Pressing of the mat can be effected at a temperature of 120° to 230° C. and with a pressure of 20–50 bar.

The surfaces of the pressed board which may be contaminated with the parting solution can be removed by grinding.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
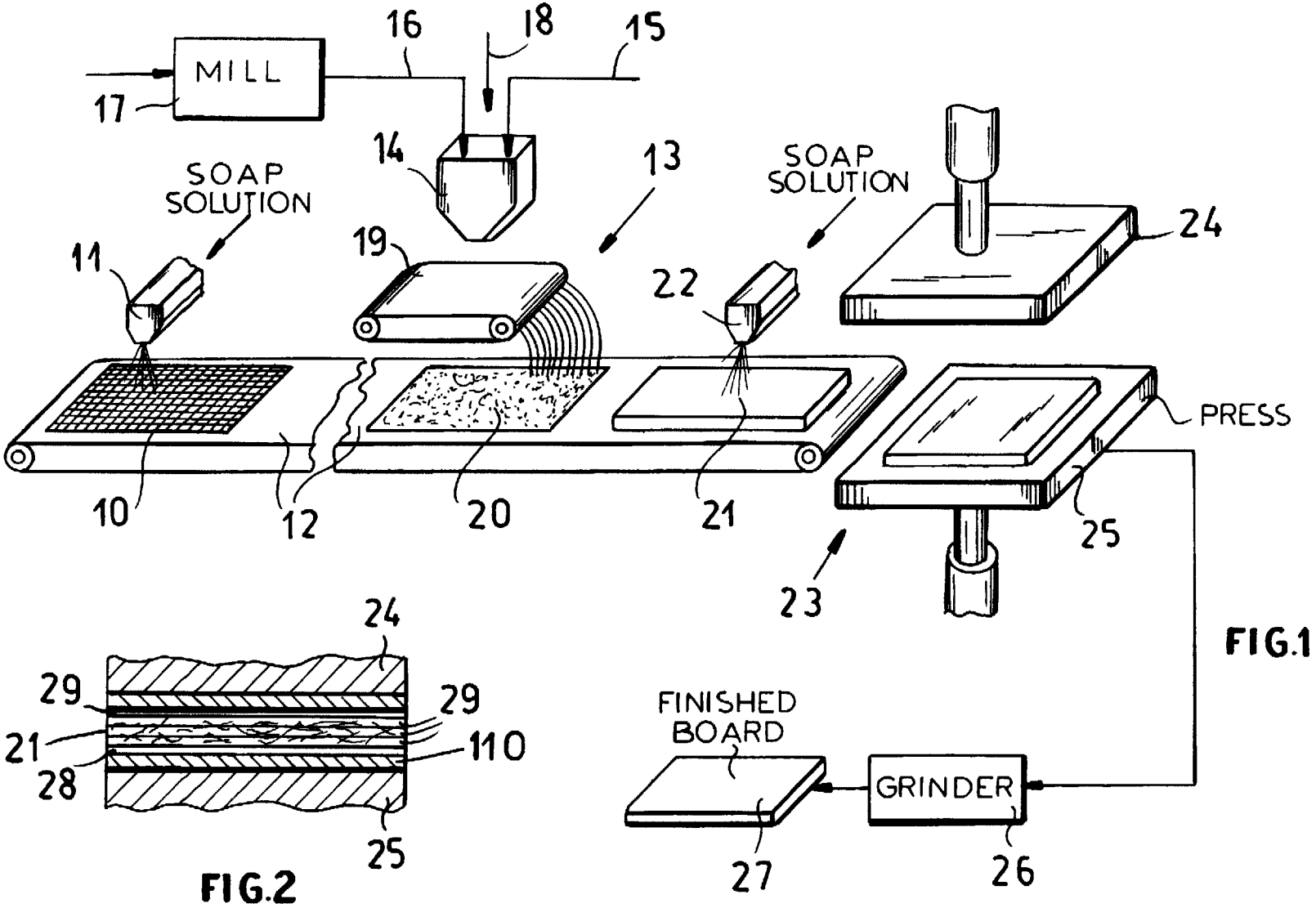
FIG. 1 is a diagrammatic perspective view of a line for the production of pressed board utilizing the method of the present invention.
FIG. 2 is a cross section through a mat in the press.

As can be seen from FIG. 1, a support 10, which can be a metal sheet, a plastic sheet or a metal screen backed by a metal sheet can be sprayed with a parting agent in the form of an aqueous soap solution and fed on a belt 12 to a spreading unit 13. The spreading unit can have a mixing bin 14 to which the isocyanate binder is fed at 15 and to which the comminuted vegetable matter, namely, straw is fed at 16 from a mill 17. The mixture, containing water added at 18, is deposited on a spreading belt 19 and deposited in a mat 20 on the support 10. The mixture contains more than sufficient water to cure the isocyanate binder. The mat is sprayed at 21 with another layer of the soap solution, e.g. via a spray head 22, the spraying being effected at a rate determined by the rate of formation of the mat. The mat on the support is then introduced into a cycling press 23 and hot pressed with an upper heated platen 24 and a lower heated platen 25 to form boards which have their upper and lower surfaces ground off in a grinding stage 26 to remove any residues of the parting soap solutions. The finished board has been shown at 27.

As will be apparent from FIG. 2, the mat 21 rests on a film 28 of the parting solution on the support 10 and has another film 29 of the soap solution between the mat and the upper press platen. The mat 21 may be made up of a number of layers 29.

SPECIFIC EXAMPLES

Example 1

For the production of pressed board, comminuted vegetable matter in the form of ground up corn stalk straw or straw from other grain production is mixed with a water hardenable isocyanate binder in the form of diphenylmethane diisocyanate (MDI) and water. The straw is initially comminuted and dried to 3% residual moisture and divided into two fractions. Fine material is separated via a sieve with a mesh width of 1 mm and the coarser particles are subjected to another separation with a sieve having a mesh width of 5 millimeters, the larger particles being reground. 100 kg of the fine material are mixed with 4 kgs of the isocyanate binder and 7 kg of water. 100 kg of the coarse fraction (1–5 mm) is mixed with 6 kg of the isocyanate binder and 1 kg water. The total moisture amounts to 4%. The amount of water exceeds by more than ten fold the amount of water required for curing the isocyanate binder.

An aqueous soap solution forming a liquid parting agent is sprayed onto a conventional steel sieve underlayment at an amount of 100 g/m$^2$ on the underlayment, initially 553 g of the fine fraction, then 1658 g of the coarse fraction and finally another 553 g of the fine material are spread. The mat has width x length x height measurements of 500×500×102 mm. 100 g/m$^2$ of the soap solution is sprayed onto the mat which can be covered with a second sieve. The resulting assembly is pressed in a cycling press at 190° C. and a pressure of 35 bar for 3 minutes. The finished board thickness was 17 mm and the surfaces were ground by 0.5 mm. The board was scarcely distinguishable from commercial furniture fabricating board. Using multiple pressings the parting agent application could be reduced to 25 g/m$^2$ and the product was obtained free from contamination by the parting agent.

Example 2

Chips of pine wood with a mean density of 470 kg/m$^3$ are formed with a length of 50 mm and a thickness of 0.25 mm. A conventional rotary blade chipper was used. Fines are collected below a sieve having a mesh width of 5 mm. The chips were dried to a moisture content of 10% and 100 kg of the chips was mixed with 6% of an isocyanate binder. Because of the high residual moisture content, no additional water had to be added since the art of water in the chips was some 27 times greater than that required for full curing of the binder. A sheet metal support was coated with 100 g/m$^2$ of a commercial soap solution acting as a parting agent, by a roller applicator. A first layer of the chips oriented in the longitudinal direction was spread onto the support. A layer twice s thick as the chips oriented in the transverse direction was then applied, followed by a further layer of chips with a longitudinal orientation. The mat had dimensions of 500×500×64 mm. The surface of the mat was then coated with 100 g/m$^2$ of the parting solution. A second metal sheet was applied to the mat and the assembly pressed in a hot press at 35 bar and 160° C. The board thickness was 16 mm and the crude density was 650 kg/m$^3$. The board had a shiny clear surface and was contaminated with the soap solution.

The tests were repeated at different temperatures with the following results.

| HEATED PLATEN TEMPERATURE °C. | HEATING TIME SECONDS | COLORATION | CONTAMINATION |
|---|---|---|---|
| 160 | 512 | SLIGHT | HIGH |
| 190 | 256 | LIGHT | HIGH |
| 220 | 128 | DARK | REDUCED |

Apparently the parting agent decomposes at higher temperatures and gives rise to discoloration of the surfaces. For construction use of the boards such discoloring and traces of the parting agent do not matter, but for other applications, the contaminated surfaces can be removed by grinding. The strength and moisture resistance (antiswelling) characteristics are significantly above the acceptable standards. In this case as well, with a succession of pressings, the parting agent application can be reduced to 25 g/m$^2$.

I claim:

1. A method of making shaped bodies comprising the steps of:

(a) mixing a comminuted vegetable material with a water-curable isocyanate binder and an amount of water in excess of that required to cure said binder to form a settable mixture;

(b) coating a support for said mixture with a layer of a liquid parting agent;

(c) depositing said settable mixture on said layer of said liquid parting agent on said support;

(d) applying to an upper side of the settable mixture on said support another layer of said liquid parting agent;

(e) thereafter pressing said settable mixture on said support at an elevated temperature and pressure to shape a body from said settable mixture while causing curing of said binder to form a shaped body.

2. The method defined in claim 1 wherein said support is a flat member, said settable mixture is provided as a layer on said member and said shaped bodies are boards.

3. The method defined in claim 2 wherein said vegetable material is a straw or comminuted wood.

4. The method defined in claim 3 wherein said vegetable material is straw comminuted to a particle length of at most 5 mm.

5. The method defined in claim 2 wherein said isocyanate binder is diphenylmethanediisocyanate.

6. The method defined in claim 2 wherein said member is a metal sheet or a sieve.

7. The method defined in claim 2 wherein said settable mixture is a mat built up of a plurality of different layers.

8. The method defined in claim 2 wherein said liquid parting agent is an aqueous soap solution.

9. The method defined in claim 2 wherein said liquid parting agent is applied to said support in step (b) and to said upper side in step (d) each in an amount of 10 to 100 g/m$^2$.

10. The method defined in claim 2 wherein said liquid parting agent is applied to said support in step (b) and to said upper side in step (d) by spraying.

11. The method defined in claim 2 wherein said liquid parting agent is applied to said support in step (b) and to said upper side in step (d) each at a rate depending upon a rate of formation of the layer of the settable mixture on said member.

12. The method defined in claim 2 wherein said press is a cycling press.

13. The method defined in claim 2 wherein said settable mixture on said support is pressed at a temperature of 120° to 230° C. and a pressure of 20 to 50 bar in step (e).

14. The method defined in claim 2, further comprising the step of grinding opposite sides of said board to remove contaminating parting agent therefrom.

15. The method defined in claim 14 wherein said parting agent is an aqueous soap solution, said settable mixture on said support being pressed at a temperature of 120° to 230° C. and a pressure of 20 to 50 bar in step (e), said liquid parting agent being applied to said support in step (b) and to said upper side in step (d) each in an amount of 10 to 100 g/m$^2$ by spraying.

16. The method defined in claim 15 wherein said vegetable material is a straw having a maximum particle length of 5 mm, or comminuted wood.

17. The method defined in claim 16 wherein said isocyanate binder is diphenylmethanediisocyanate.

18. The method defined in claim 17 wherein said member is a metal sheet or a sieve.

19. The method defined in claim 18 wherein said settable mixture is a mat built up of a plurality of different layers.

* * * * *